US009190203B2

(12) United States Patent
Eom et al.

(10) Patent No.: US 9,190,203 B2
(45) Date of Patent: Nov. 17, 2015

(54) TRANSFORMER COOLING APPARATUS AND TRANSFORMER ASSEMBLY INCLUDING THE SAME

(71) Applicant: LSIS CO., LTD., Anyang-si, Gyeonggi-do (KR)

(72) Inventors: Jun Seok Eom, Pyeongtaek-si (KR); Jae Ho Lee, Bucheon-si (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 48 days.

(21) Appl. No.: 13/868,922

(22) Filed: Apr. 23, 2013

(65) Prior Publication Data

US 2013/0314185 A1 Nov. 28, 2013

(30) Foreign Application Priority Data

May 22, 2012 (KR) ..... 10-2012-0054306

(51) Int. Cl.

| | |
|---|---|
| ***H01F 27/08*** | (2006.01) |
| ***H01F 27/10*** | (2006.01) |
| ***H01F 27/02*** | (2006.01) |
| ***H01F 27/22*** | (2006.01) |

(52) U.S. Cl.

CPC ..... *H01F 27/08* (2013.01); *H01F 27/22* (2013.01)

(58) Field of Classification Search

CPC ..... H01F 27/22; H01F 27/08
USPC ..... 336/55, 57–62
See application file for complete search history.

(56) References Cited

U.S. PATENT DOCUMENTS

| | | | | |
|---|---|---|---|---|
| 4,945,332 | A * | 7/1990 | Sakamoto et al. | 336/69 |
| 7,212,406 | B2 * | 5/2007 | Kaishian et al. | 361/699 |
| 2009/0179721 | A1 * | 7/2009 | Wernicki | 336/60 |
| 2010/0209314 | A1 * | 8/2010 | Sato | 422/198 |

FOREIGN PATENT DOCUMENTS

| | | | |
|---|---|---|---|
| CN | 101895189 | | 11/2010 |
| JP | 2004-095570 | | 3/2004 |
| JP | 2007-180145 | | 7/2007 |
| JP | 2008-311284 | | 12/2008 |
| JP | 2010-118610 | | 5/2010 |
| JP | 2010-272870 | | 12/2010 |
| JP | 2011135062 | A * | 7/2011 |
| JP | 2011-181856 | | 9/2011 |
| JP | 2011181856 | A * | 9/2011 |
| KR | 1020040006636 | | 1/2004 |
| KR | 1020100080088 | | 7/2010 |
| KR | 1020110057712 | | 6/2011 |
| KR | 20110090736 | | 8/2011 |

OTHER PUBLICATIONS

The State Intellectual Property Office of the People's Republic of China Application Serial No. 201310192658.2, Office Action dated May 19, 2015, 9 pages.

* cited by examiner

*Primary Examiner* — Tsz Chan
(74) *Attorney, Agent, or Firm* — Lee, Hong, Degerman, Kang & Waimey

(57) ABSTRACT

Provided are a transformer cooling apparatus and a transformer assembly including the same. The transformer cooling apparatus includes a first plate on which a transformer including a magnetic member and a coil is seated, a second plate disposed on a side of the first plate, the second plate being spaced apart from the first plate, and a coolant passage in which a coolant flows, the coolant passage being defined between the first plate and the second plate.

10 Claims, 4 Drawing Sheets

TRANSFORMER COOLING APPARATUS AND TRANSFORMER ASSEMBLY INCLUDING THE SAME

CROSS REFERENCE TO RELATED APPLICATION

Pursuant to 35 U.S.C. §119(a) this application claims benefit of earlier filing date and right of priority to Korean Patent Application No. 10-2012-0054306, filed on May 22, 2012, the contents of which is incorporated by reference herein in its entirety.

BACKGROUND

The present disclosure relates to a transformer cooling apparatus.

In general, a pole transformer is installed on an electric pole to transform a high voltage distributed from an electric power substation through a high tension cable into a predetermined voltage, thereby distributing the transformed voltage into homes or buildings.

Normal electric transformers are devices that convert an AC voltage or current by using electromagnetic induction. There are many different types of transformers such as power transformers connected to power transmission/distribution lines and coupling transformers used in electronic circuits.

Such a power transformer may step up or down a predetermined voltage that is applied into an AC circuit. However, electric power is not changed in spite of the step up or down of the voltage. The transformer has a structure in which a primary coil connected to a power source and a secondary coil connected to a load are wound around a core member, e.g., an iron core or ferrite core.

When power is applied into the primary coil so that a current flows, an electrical field is generated around the primary coil and the core member. Here, when the current supplied from the power source is changed according to a time, the electrical field may be changed in intensity. Thus, the electrical field may be transferred into the secondary coil through the core member to change the intensity of the electrical field passing through the secondary coil according to a time.

Also, an induced electromotive force may be generated in the secondary coil by electromagnetic induction, and thus, an induced current flows in the secondary coil.

The transformer may be connected to a converter provided in a power control device. The transformer may insulate a high voltage applied into the converter to convert the voltage. When the transformer operates, the transformer may generate a large amount of heat while power is applied into the coil to generate the electromagnetic induction.

According to the transformer or a mounting structure of the transformer, the heat generated in the transformer is not adequately dissipated to the outside of the converter or the power control device. Thus, the transformer may be overloaded. In addition, the transformer, the converter, or the power control device may malfunction to reduce reliability in operation.

SUMMARY

Embodiments provide a transformer cooling apparatus that is capable of effectively dissipating heat generated in a transformer.

In one embodiment, a transformer cooling apparatus includes: a first plate on which a transformer including a magnetic member and a coil is seated; a second plate disposed on a side of the first plate, the second plate being spaced apart from the first plate; and a coolant passage in which a coolant flows, the coolant passage being defined between the first plate and the second plate.

In another embodiment, a transformer assembly includes: a plurality of magnetic members coupled to a coil; a first plate defining a support surface that supports the plurality of magnetic members; a second plate spaced apart from the first plate; a coolant passage defined between the first plate and the second plate; a coolant inflow part through a coolant is introduced into the coolant passage; and a coolant discharge part through which the coolant circulating into the coolant passage is discharged.

The details of one or more embodiments are set forth in the accompanying drawings and the description below. Other features will be apparent from the description and drawings, and from the claims.

DETAILED DESCRIPTION OF THE EMBODIMENTS

Figure 1:
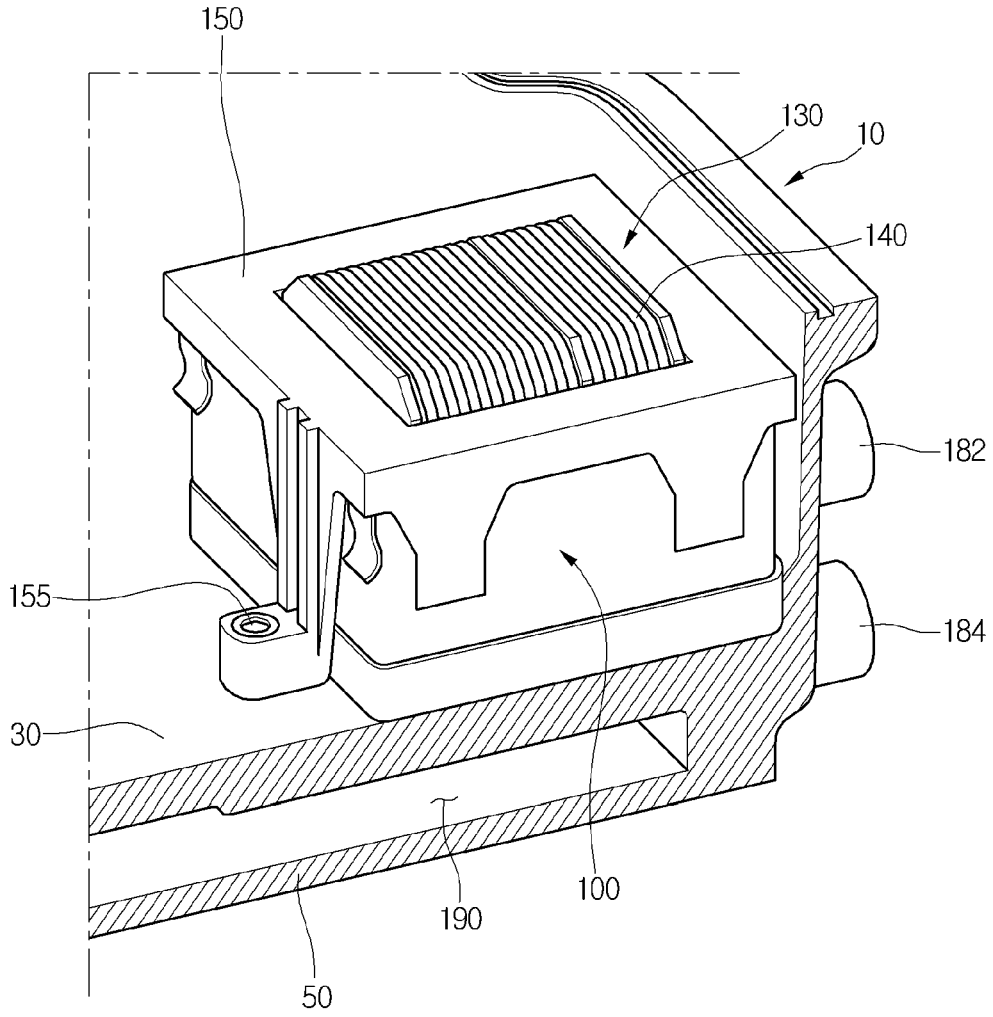
FIG. 1 is a view illustrating a state in which a transformer is mounted on a specific unit according to an embodiment.
Figure 2:
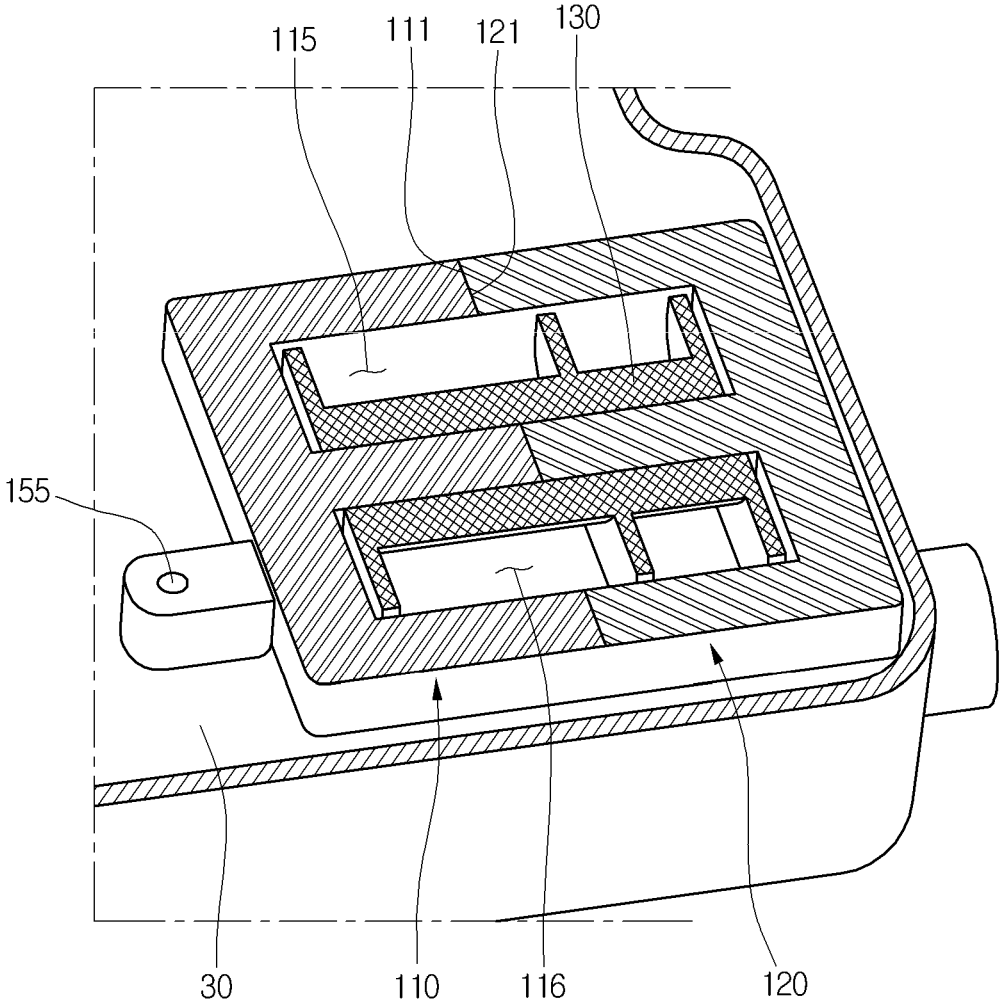
FIG. 2 is a horizontal cross-sectional view illustrating a mounting structure of the transformer according to an embodiment.
Figure 3:
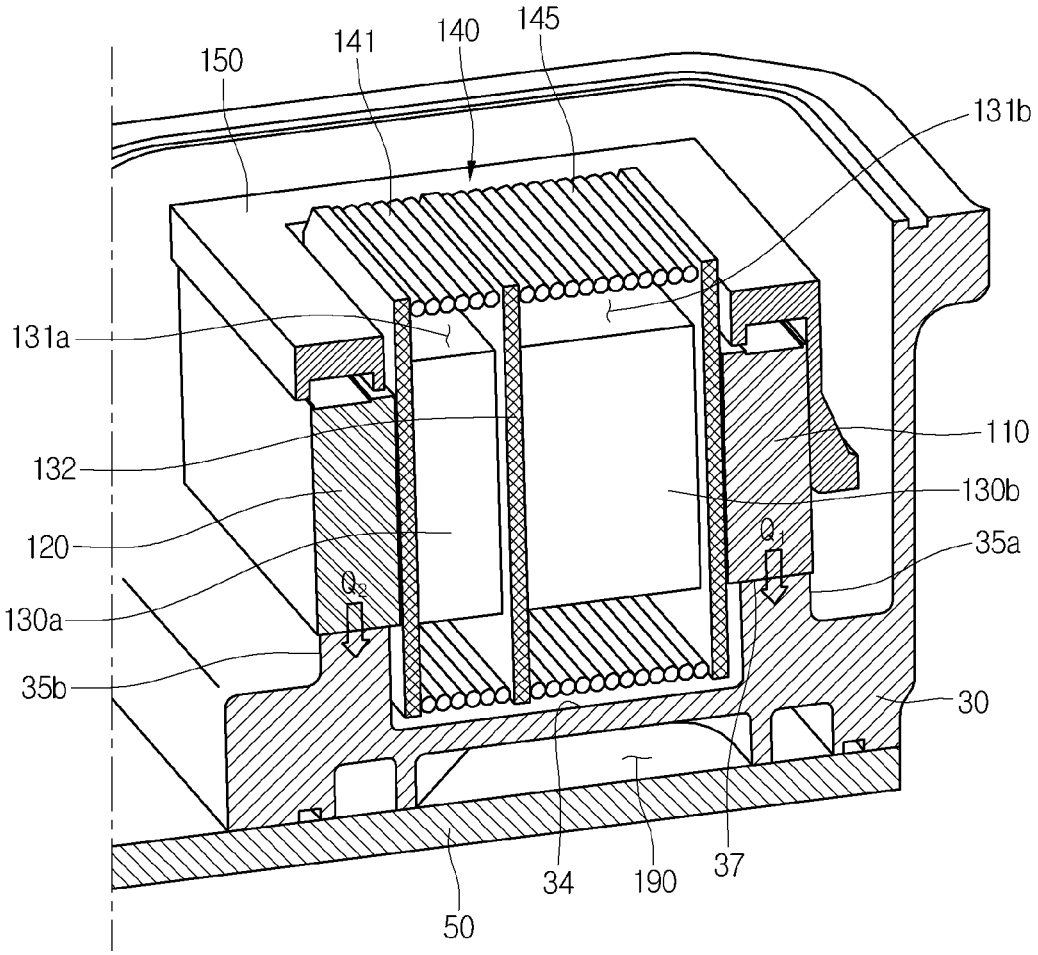
FIG. 3 is a vertical cross-sectional view illustrating the mounting structure of the transformer according to an embodiment.

FIG. 1 is a view illustrating a state in which a transformer is mounted on a specific unit according to an embodiment, FIG. 2 is a horizontal cross-sectional view illustrating a mounting structure of the transformer according to an embodiment, and FIG. 3 is a vertical cross-sectional view illustrating the mounting structure of the transformer according to an embodiment.

Referring to FIGS. 1 to 3, a transformer 100 according to an embodiment may be disposed on a mount unit 10. For example, the mount unit 10 may be a power control device on which the transformer 100 is disposed. The transformer 100 and the mount unit 10 may be commonly called a "transformer assembly".

The mount unit 10 includes a first plate 30 on which the transformer 100 is seated and a second plate 50 having one surface spaced downward from one surface of the first plate 30. A side of the first plate 30 may be coupled to a side of the second plate 50. Alternatively, the first and second plates 30 and 50 may be integrated with each other.

The mount unit 10 includes a coolant passage 190 that is defined as at least one portion of a space between the first plate 30 and the second plate 50.

The first plate 30 may be called a "support" or "support plate" in that the first plate 30 is disposed under the transformer 100 to support the transformer 100. Also, the second plate 50 may be called a "passage formation part" in that the second plate 50 is spaced apart from the first plate 30 to define the coolant passage 190.

Also, a coolant inflow part 182 through which a coolant is introduced into the coolant passage 190 and a coolant discharge part 184 through which the coolant circulating into the coolant passage 190 is discharged to the outside of the mount unit 10 are disposed in one surface of the mount part 10. The coolant inflow part 182 and the coolant discharge part 184 may be disposed in the same surface of the mount unit 10.

However, the present disclosure is not limited to the positions of the coolant inflow part 182 and the coolant discharge part 184. For example, the coolant inflow part 182 and the coolant discharge part 184 may be disposed on different surfaces, respectively.

The mount unit 10 further includes a fixing member 150 for fixing the transformer 100 to the mount unit 10. The fixing member 150 may be disposed above the transformer 100 to press at least one portion of a top surface of the mount unit 10. Also, the fixing member 150 may extend downward from the top surface of the mount unit 10 and then be fixed to the first plate 30.

A coupling part 155 to which the fixing member 150 is coupled is disposed on the first plate 30. A coupling member is coupled to the coupling part 155. The coupling member fixes the coupling part 155 to the fixing member 150.

The transformer 100 includes a plurality of magnetic parts 110 and 120 that serve as a core member and a coil mount part 130 coupled to the plurality of magnetic parts 110 and 120. A coil 140 may be coupled to an outer circumferential surface of the coil mount part 130.

Each of the magnetic parts 110 and 120 may be formed of a ferrite material. The plurality of magnetic parts 110 and 120 include a first magnetic part 110 supported on the first plate 30 and a second magnetic part 120 disposed on a side of the first magnetic part 110 and supported on the first plate 30. The first magnetic part 110 and the second magnetic part 120 may be coupled to each other.

An end of the first magnetic part 110 may contact an end of the second magnetic part 120. For example, as shown in FIG. 2, the end of the first magnetic part 110 includes a plurality of first ends 111, and the end of the second magnetic part 120 includes a plurality of second ends 121. The plurality of first ends 111 and the plurality of second ends 121 may contact each other.

The coil mount part 130 is disposed to surround at least one portions of the plurality of magnetic parts 110 and 120. For example, as shown in FIG. 2, the coil mount part 130 may be disposed inside the plurality of magnetic parts 110 and 120.

In detail, the plurality of magnetic parts 110 and 120 have a plurality of accommodation spaces 115 and 116 in which the coil mount part 130 and the coil 140 are disposed. The plurality of accommodation spaces 115 and 116 include a first accommodation space 115 in which at least one portion of the coil mount part 130 is disposed and a second accommodation space 116 spaced apart from the first accommodation space and in which the remaining portion of the coil mount part 130 is disposed.

Portions of the plurality of magnetic parts 110 and 120 may be disposed in a space between the first accommodation space 115 and the second accommodation space 116.

A partition rib 132 for partitioning a space or surface where the coil 140 is mounted is disposed on the coil mount part 130. The partition rib 132 may partition a space for the coil mount part 130 on which the coil 140 is mounted into mounting spaces 131*a* and 131*b* having different sizes.

In detail, the coil mount part 130 includes a first coil mount part 130*a* and a second coil mount part 130*b* which are partitioned by the partition rib 132. Also, a first mounting space 131*a* and a second mounting space 131*b* which are partitioned by the partition rib 132 are defined outside the coil mount part 130. The first mounting space 131*a* may be defined to surround the outside of the first coil mount part 130*a*, and the second mounting space 131*b* may be defined to surround the outside of the second coil mount part 130*b*.

The coil 140 includes a primary coil 141 coupled in the first mounting space 131*a* and a secondary coil 145 coupled in the second mounting space 131*b*.

The primary coil 141 and the secondary coil 145 are disposed to surround an outer circumferential surface of the coil mount part 130. In detail, the primary coil 141 is disposed in the first mounting space 131*a*, and the secondary coil 145 is disposed in the second mounting space 131*b*. One of the primary coil 141 and the secondary coil 145 may be a coil connected to a power source, and the other one may be a coil in which a current is induced.

A plurality of protrusions 35*a* and 35*b* supporting at least one portions of bottom surfaces of the first and second magnetic parts 110 and 120 are disposed on the first plate 30. The plurality of protrusions 35*a* and 35*b* include a first protrusion 35*a* supporting the first magnetic part 110 and a second protrusion 35*b* supporting the second magnetic part 120. The plurality of protrusions 35*a* and 35*b* may be called a "contact part" contacting the first and second magnetic parts 110 and 120.

The first and second protrusions 35*a* and 35*b* respectively contact the first and second magnetic parts 110 and 120 of the first plate 30. Also, the first and second protrusions 35*a* and 35*b* protrude from a bottom surface of the first plate 30 toward the first and second magnetic parts 110 and 120, respectively.

The first and second protrusions 35*a* and 35*b* include a support surface 37. The support surface 37 may be surfaces of the first and second protrusions 35*a* and 35*b* to contact each of the first and second magnetic parts 110 and 120.

That is to say, the support surface 37 may be a thermal transfer surface that receives heat from top surfaces of the first and second protrusions 35*a* and 35*b*. That is, the first magnetic part 110 contacts the first protrusion 35*a* to transfer heat Q1 into the first protrusion 35*a*. Also, the second magnetic part 120 contacts the second protrusion 35*b* to transfer heat Q2 into the second protrusion 35*b*.

A recess part 34 that is recessed to accommodate at least one portion of the transformer 100 is defined between the first protrusion 35*a* and the second protrusion 35*b*. The coil mount part 130 and the coil 140 may be disposed in the recess part 34.

In detail, lower portions of the first and second coil mount parts 130*a* and 130*b*, a lower portion of the partition rib 132, and at least one portion of the coil 140 may be accommodated in the recess part 34.

In summary, the first and second magnetic parts 110 and 120 are disposed in a horizontal or left and right direction to contact the first plate 30.

That is, the first plate 30 may include the plurality of protrusions 35*a* and 35*b* contacting the first and second magnetic parts 110 and 120 to stably support the first and second magnetic parts 110 and 120.

Also, since heat generated in the first and second magnetic parts 110 and 120 is transferred into the first plate 30 through the support surface 37, a thermal contact (or thermal transfer) area may be secured to effectively dissipate heat.

Also, since at least one portion of the transformer 100 is accommodated in the recess part 34, the transformer 100 may be compactly mounted on the first plate 30.

The coolant passage 190 in which the coolant flows is defined between the first plate 30 and the second plate 50. The second plate 50 has a predetermined structure that defines the coolant passage 190 to enable the coolant to smoothly flow. Hereinafter, a structure of the second plate 50 will be described with reference to the accompanying drawing.

Figure 4:
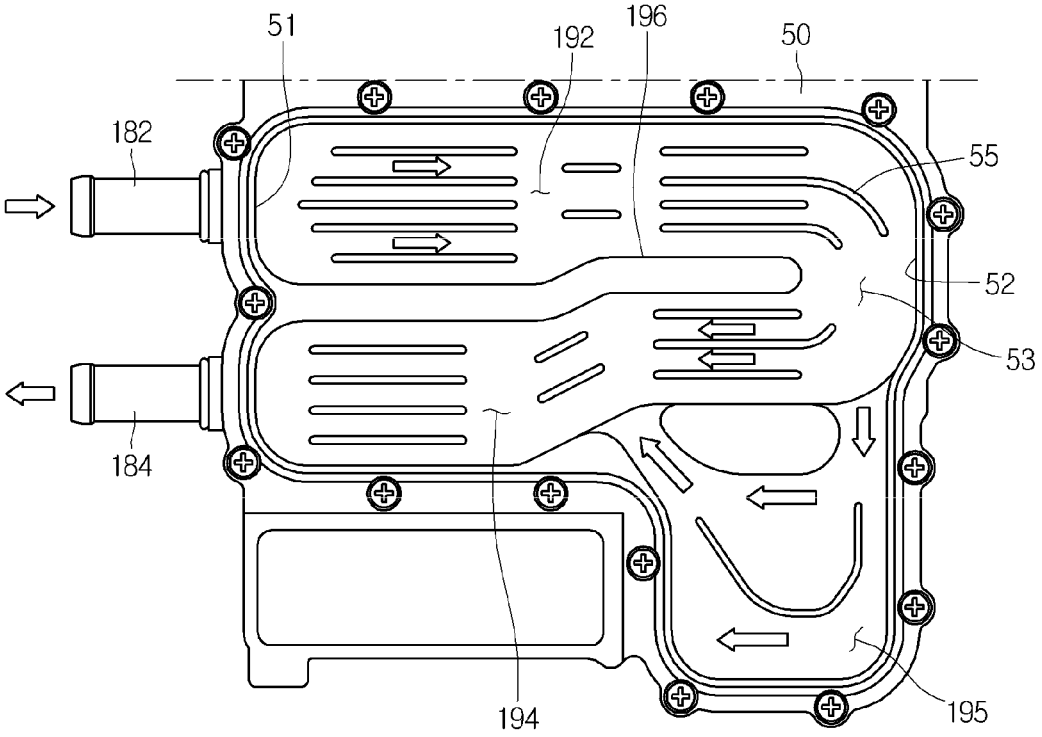
FIG. 4 is a view illustrating a second plate having a coolant passage according to an embodiment.

FIG. 4 is a view illustrating the second plate having the coolant passage according to an embodiment.

Referring to FIG. 4, at least one portion of the coolant passage 190 is defined in the second plate 50 according to an embodiment. The coolant passage 190 includes an inflow passage 192 defined inside the coolant inflow part 182 and a discharge passage 194 defined in the coolant discharge part 184.

The second plate 50 includes a passage partition part 196 for partitioning the inflow passage 192 and the discharge passage 194. The passage partition part 196 is disposed between the inflow passage 192 and the discharge passage 194.

In detail, the passage partition part 196 protrudes upward from the second plate 50 to contact the first plate 30.

The passage partition part 196 protrudes from a first surface 51 of the second plate 50, in which the coolant inflow part 182 and the coolant discharge part 184 are disposed, toward a second surface 52. Also, the passage partition part 196 has an end spaced apart from the second surface 52. Here, the first and second surfaces 51 and 52 may face each other.

Thus, the coolant introduced through the coolant inflow part 182 flows into the inflow passage 192 along the passage partition part 196 and then is introduced into the discharge passage 194 through a space part 53 defined between the end of the passage partition part 196 and the second surface 52.

That is, one end of the inflow passage 192 and the other end of the discharge passage 194 may communicate with each other through the space part 53. The coolant introduced into the inflow passage 192 may flow by a predetermined distance, and then be introduced into the discharge passage 194 via the space part 53.

As a result, since the passages 192 and 194 are partitioned by the passage partition part 196, the coolant flowing into the inflow passage 192 through the coolant inflow part 182 is not directly introduced into the discharge passage 194, but flows by a predetermined distance (a right direction in FIG. 4) and then is switched in flow direction to flow into the discharge passage 194.

The coolant passage 190 further includes a bypass passage 195 defined in a side of the discharge passage 194. The bypass passage 195 may bypass at least one portion of the coolant flowing into the inflow passage 192 to introduce the at least one portion of the coolant into the discharge passage 194.

That is, at least one portion of the coolant passing through the space part 53 is introduced into the discharge passage 194, and remaining coolant flows through the bypass passage 195 and then is introduced into the discharge passage 194.

That is to say, the coolant is divided to flow the discharge passage 194 and the bypass passage 195. Then, the coolant flowing into the bypass passage 195 flows by a predetermined distance and then is mixed with the coolant flowing into the discharge passage 194. As described above, since the coolant flows into the bypass passage 195, the thermal transfer area through the coolant may increase.

A guide rib 55 guiding a flow of the coolant in the coolant passage 190 is disposed on the second plate 50. The guide rib 55 protrudes upward from a bottom surface of the second plate 50. Also, the guide rib 55 may be provided in plurality, and the plurality of guide ribs 55 may be spaced apart from each other.

The coolant introduced through the coolant inflow part 182 may be guided into the inflow passage 192, the bypass passage 195, and the discharge passage 194 by the guide rib 55 and then be easily discharged into the coolant discharge part 184.

As a result, since the coolant uniformly circulates into the coolant passage 190, heat generated in the transformer 100, i.e., heat transferred into the first plate 30 may be sufficiently cooled.

Although the passage partition part 196 or the guide rib 55 is disposed on the second plate 50 in the current embodiment, the present disclosure is not limited thereto. For example, the passage partition part 196 or the guide rib 55 may be disposed on the first plate 30.

In summary, heat generated in the transformer 100 may be transferred into the first plate 30 contacting the transformer 100. Also, the heat transferred into the first plate 30 may be cooled by the coolant flowing into the space between the first plate 30 and the second plate 50.

Therefore, since the heat generated in the transformer 100 is dissipated to the outside, reliability with respect to the operation of the transformer 100 or the mount unit 10 may be secured.

According to the embodiment, a contact area between the magnetic member provided in the transformer and the plate on which the transformer is mounted may increase to improve heat dissipation through the plate.

That is, the protrusion on which the core member of the transformer is seated may be disposed on the plate on which the transformer is mounted, and the support surface defined on one surface of the protrusion may contact the core member to increase the thermal transfer area.

Also, since the protrusion may be integrally manufactured or processed with the plate, manufacturing process may be simplified, and manufacturing costs may be reduced.

Also, since the coolant passage is defined in a side of the transformer to cool heat generated in the transformer, the heat dissipation effects may be improved.

Also, a structure for guiding a flow of the coolant may be adopted in the coolant passage so that the coolant smoothly flows to improve the cooling effects.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A transformer cooling apparatus comprising:

a first plate on which a transformer is seated, the transformer comprising a coil and a magnetic member including a first magnetic part and a second magnetic part;

a first protrusion configured to protrude from an upper surface of the first plate to contact the first magnetic part;

a second protrusion configured to protrude from the upper surface of the first plate to contact the second magnetic part;

a recess defined between the first protrusion and the second protrusion and shaped to accommodate at least a portion of the transformer;

a second plate spaced apart from the first plate;

third and fourth protrusions configured to protrude from a lower surface of the first plate to contact the second plate;

a coolant passage in which a coolant flows, the coolant passage being defined by a lower surface of the first plate, an upper surface of the second plate, and the third and fourth protrusions;

a coil mount positioned in an accommodation space defined by the first and the second magnetic parts, the accommodation space having a mounting space in which the coil is mounted; and a partition rib partitioning the mounting space into a plurality of spaces;

wherein at least a portion of the coil mount, the coil, and the partition rib is received in the recess part.

2. The transformer cooling apparatus according to claim 1, wherein the first and second magnetic parts are arranged in a same direction and are respectively supported on top surfaces of the first and second protrusions.

3. The transformer cooling apparatus according to claim 1, wherein a size of each of the plurality of spaces is different.

4. The transformer cooling apparatus according to claim 1, further comprising:

a coolant inflow part through which the coolant is introduced into the coolant passage; and a coolant discharge part through which the coolant circulating into the coolant passage is discharged.

5. The transformer cooling apparatus according to claim 1, wherein the coolant passage comprises an inflow passage and a discharge passage, and at least one of the first or second plate further comprises a passage partition part partitioning the inflow passage and the discharge passage.

6. The transformer cooling apparatus according to claim 5, wherein the coolant passage further comprises a bypass passage bypassing the coolant passing through the inflow passage, and the coolant passes through the bypass passage and is mixed with the coolant flowing into the discharge passage.

7. The transformer cooling apparatus according to claim 5, wherein the second plate comprises:

a first surface to which the passage partition part is coupled; and a second surface defined on a surface opposite to the first surface, the second surface being apart from an end of the passage partition part.

8. The transformer cooling apparatus according to claim 6, wherein the second plate comprises a space part defined between an end of the passage partition part and one surface of the second plate to divide the coolant to flow into the discharge passage and the bypass passage.

9. The transformer cooling apparatus according to claim 1, wherein at least one of the first or second plate comprises a guide rib guiding the coolant flowing into the inflow passage to the discharge passage.

10. The transformer cooling apparatus according to claim 9, wherein the guide rib is provided in plurality that is spaced apart from each other.

* * * * *